US005890765A

United States Patent [19]

LaPointe et al.

[11] Patent Number: 5,890,765

[45] Date of Patent: Apr. 6, 1999

[54] HEALTH CARE RECLINING CHAIR

[75] Inventors: Larry P. LaPointe, Temperance; Mark D. Miller, Monroe; Jonathan R. Saul, Erie; Mark A. Brettschneider; Donald A. George, both of Monroe, all of Mich.

[73] Assignee: La-Z-Boy Incorporated, Monroe, Mich.

[21] Appl. No.: 659,998

[22] Filed: Jun. 7, 1996

[51] Int. Cl.[6] ..... A47C 1/02

[52] U.S. Cl. ..... 297/354.13; 297/342; 297/173; 297/162; 108/128

[58] Field of Search ..... 297/354.13, 343, 297/342, 173, 162, 143, 155, 154, 188.15; 108/43, 128, 80, 78

[56] References Cited

U.S. PATENT DOCUMENTS

| | | | |
|---|---|---|---|
| 2,578,311 | 12/1951 | Lorenz | 297/354.13 |
| 3,096,121 | 7/1963 | Knabusch et al. . | |
| 3,525,549 | 8/1970 | Knabusch et al. . | |
| 3,567,276 | 3/1971 | Van Ryn | 297/162 |
| 3,869,172 | 3/1975 | James et al. . | |
| 3,904,240 | 9/1975 | Rogers, Jr, et al. . | |
| 4,153,292 | 5/1979 | White et al. . | |
| 4,350,387 | 9/1982 | Rogers, Jr. . | |
| 4,367,895 | 1/1983 | Pacitti et al. . | |
| 5,106,153 | 4/1992 | Durling . | |
| 5,141,284 | 8/1992 | LaPointe . | |
| 5,184,871 | 2/1993 | LaPointe et al. . | |
| 5,288,126 | 2/1994 | Saul et al. . | |
| 5,301,413 | 4/1994 | Habegger et al. . | |
| 5,315,726 | 5/1994 | Borenstein | 297/354.13 |
| 5,328,235 | 7/1994 | Saul et al. . | |
| 5,402,544 | 4/1995 | Crawford et al. | 297/354.13 |
| 5,474,359 | 12/1995 | Muffi | 297/354.13 |
| 5,570,930 | 11/1996 | LaPointe et al. | 297/342 |

FOREIGN PATENT DOCUMENTS

| | | | |
|---|---|---|---|
| 2497448 | 7/1982 | Japan | 297/354.13 |

OTHER PUBLICATIONS

Nemschoff, Dialysis Chair™, Patient Seating Publication.
Nemschoff, SleepOver™, Patient Room Seating Publication.
Nemschoff, Pristo™, Treatment Chair Publication.

*Primary Examiner*—Peter M. Cuomo
*Assistant Examiner*—Anthony D. Barfield
*Attorney, Agent, or Firm*—Harness, Dickey & Pierce, P.L.C.

[57] ABSTRACT

A health care reclining chair is disclosed which includes a rigid chair frame assembly. An improved deep recline swing linkage assembly is disclosed which permits the seat back of the chair to be fully reclined into a substantially flat position relative to the seat and operably suspends the seat assembly for reclining motion within the chair frame assembly. A mobile base assembly is interdisposed between the chair frame assembly and the floor to permit the reclining chair to be used for transportation of a seated occupant. Furthermore, a tilting mechanism is operably coupled between the mobile base assembly and the chair frame assembly for permitting tilting movement of the chair frame relative to the base assembly. The health care reclining chair of the present invention may further be adapted to include a leg rest assembly positionable between a retracted position and an extended position for providing further comfort. In this manner, the seat assembly provides a substantially flat occupant-supporting surface which is generally parallel to the floor surface to define a bed-like surface which may be further oriented to place a head rest portion of the seat back slightly below a foot rest portion of the leg rest assembly for placing an occupant in a trendelenburg position.

23 Claims, 11 Drawing Sheets

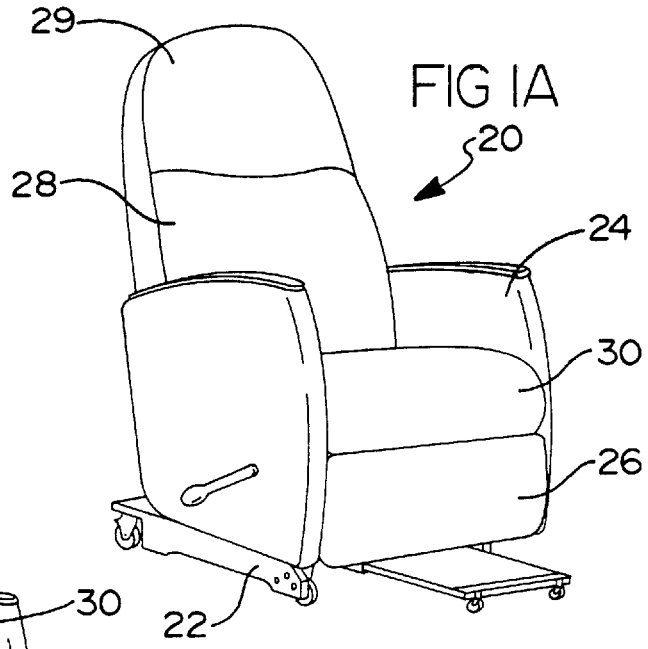
FIG IA
FIG IB
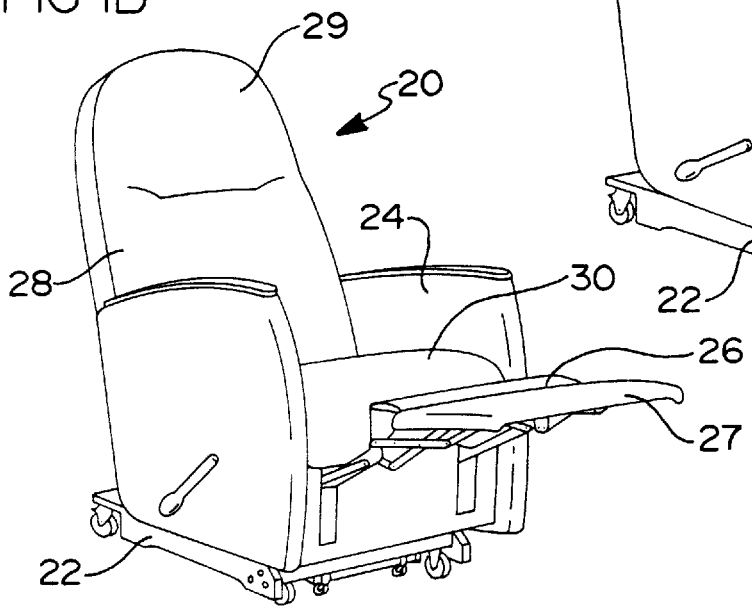
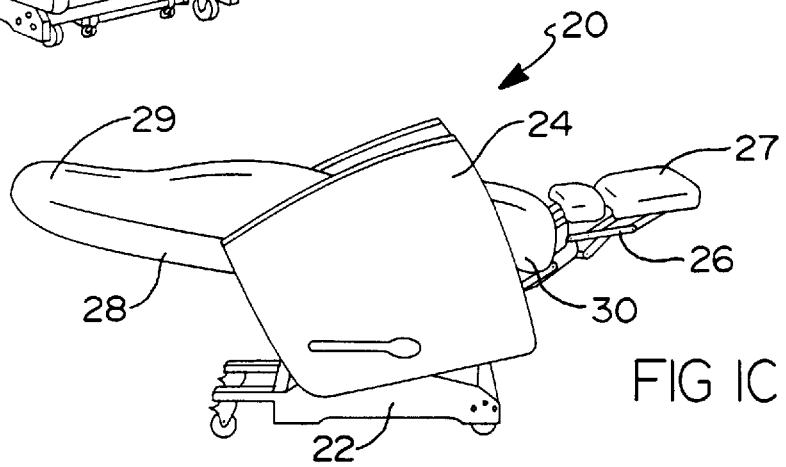
FIG IC
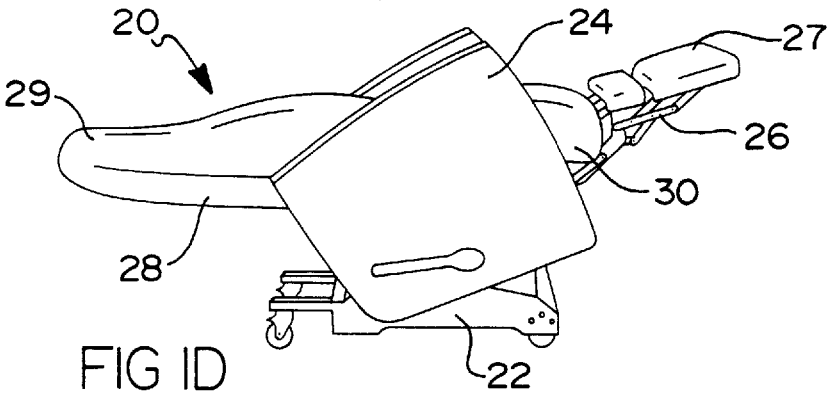
FIG ID 28
30
86
26
86
82
82
84
114
80
20
74
72
174
66
64
76
72
64
172
78
70
68
114
34
50
60
62
32
90
24
36
40
44
60
50
90
62
88
52
38
58
94
46
54
44
22
48
38
40
56
32

FIG 3
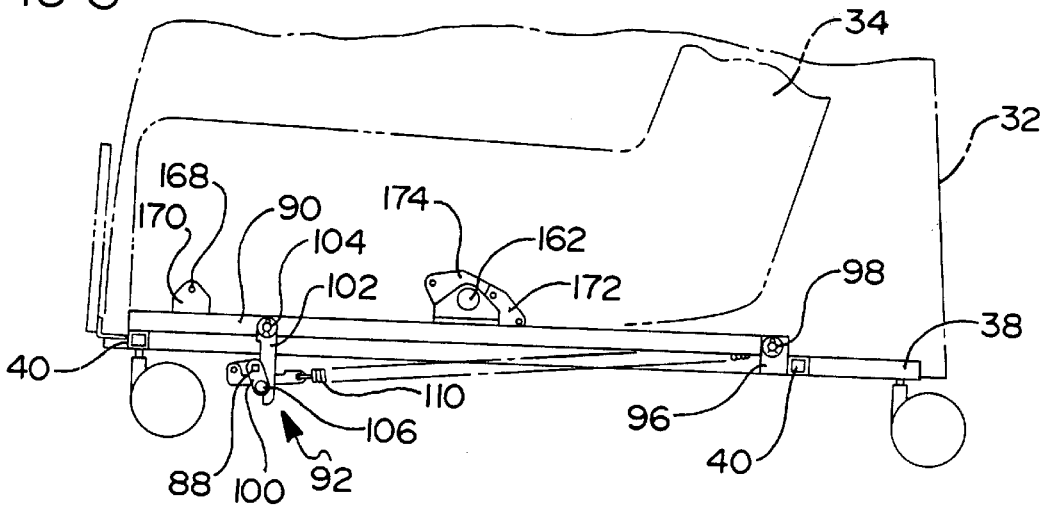
FIG 4
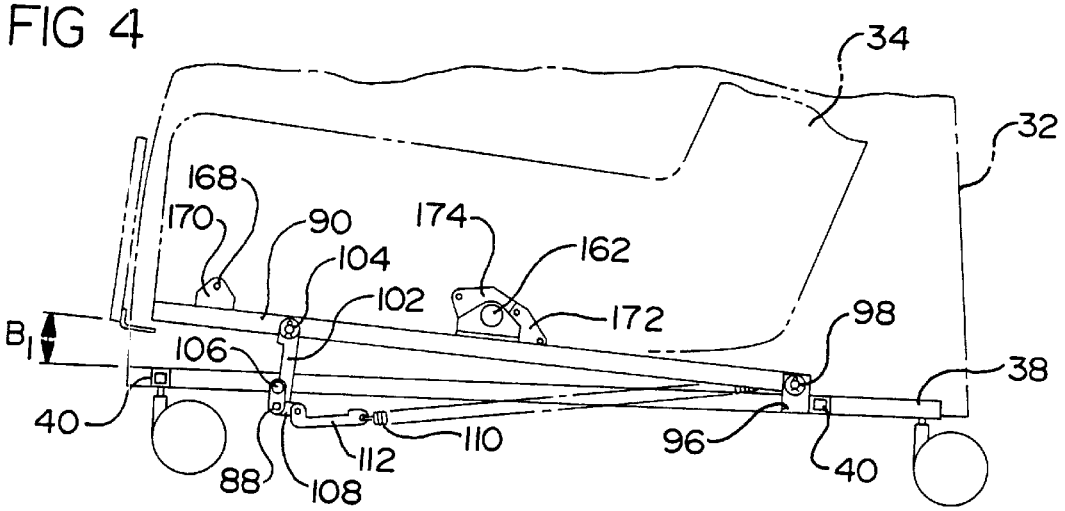
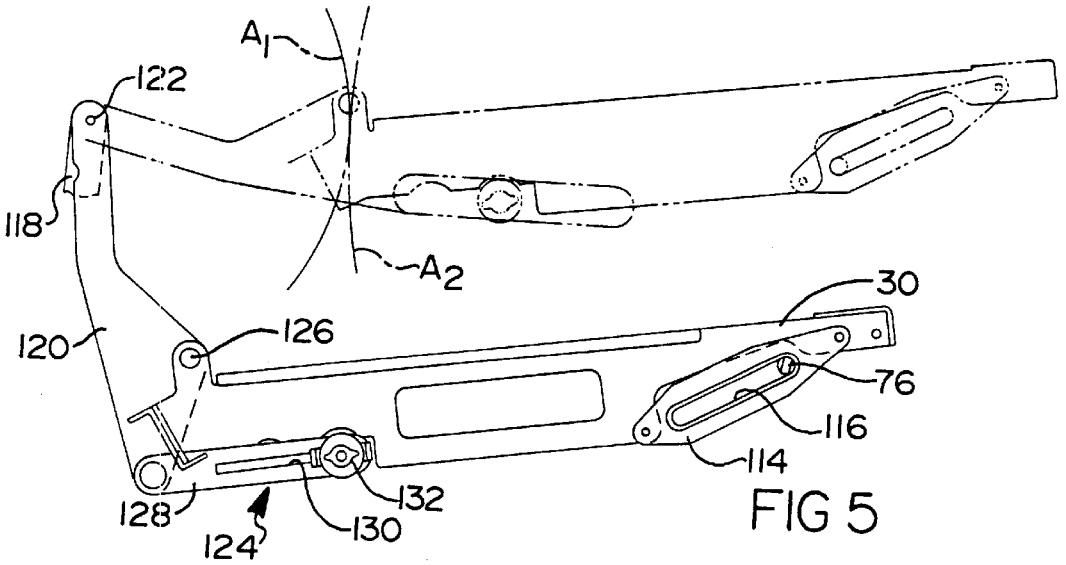
FIG 5

FIG 6
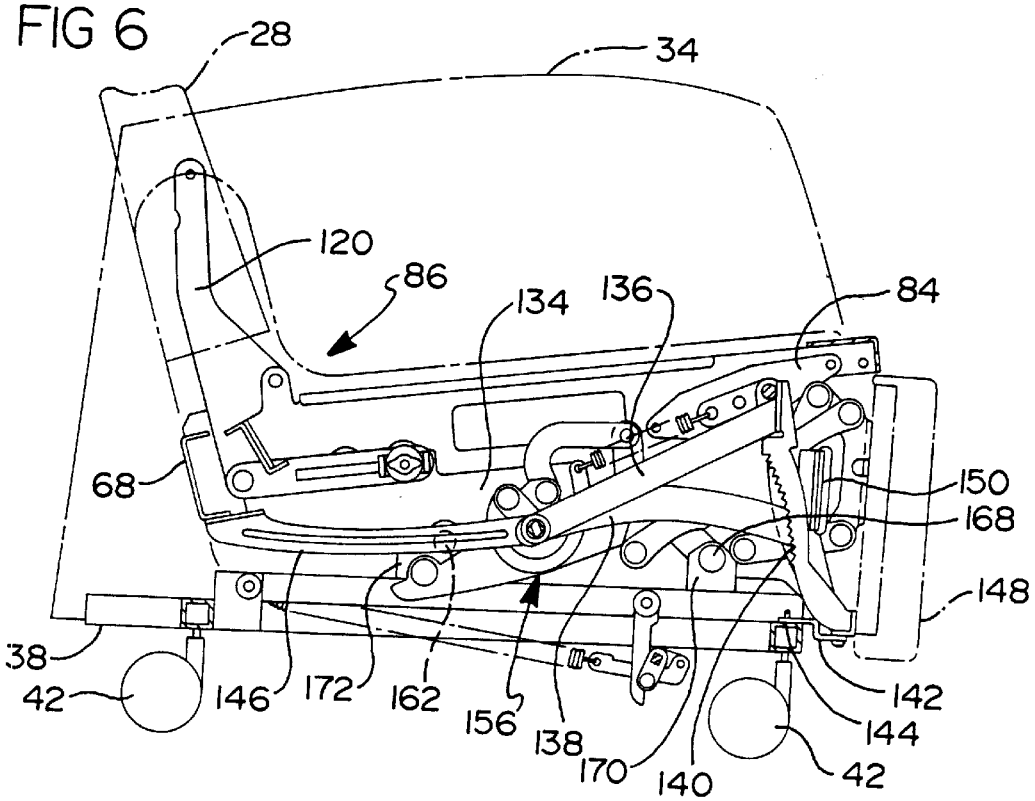
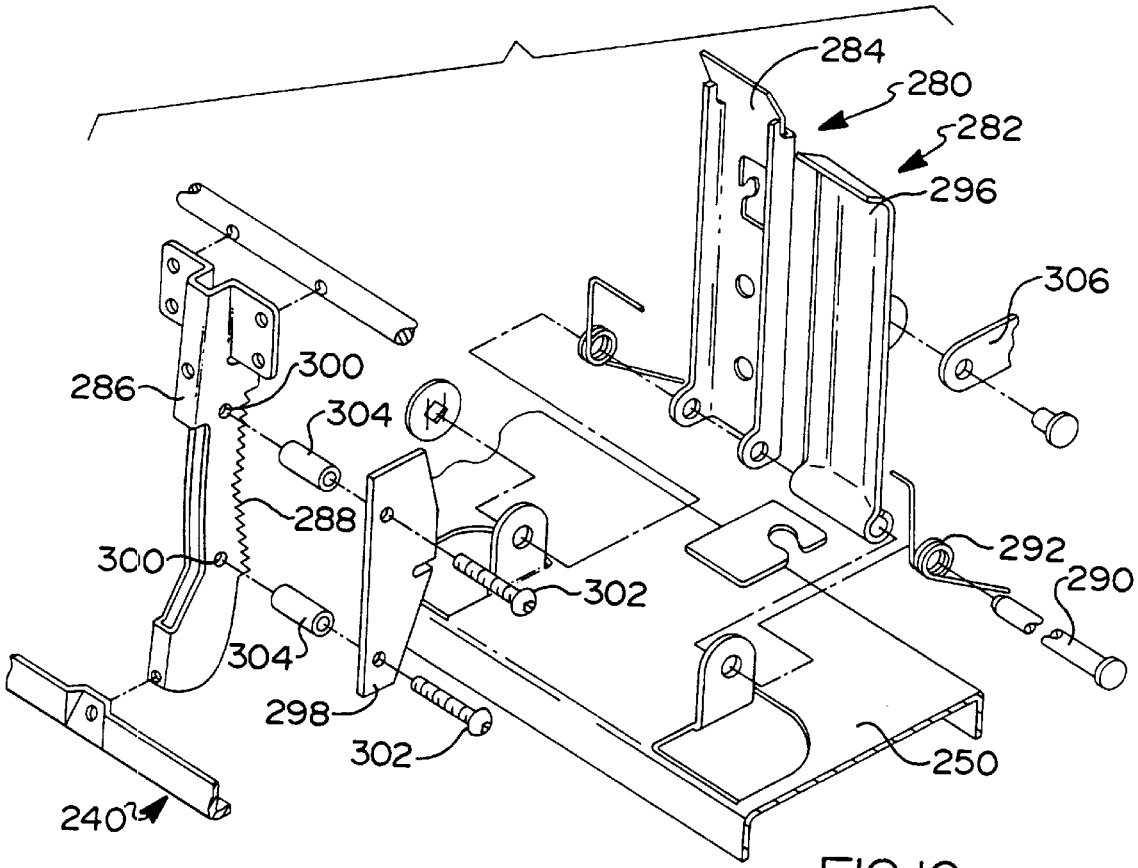
FIG 10

228
230
226
338
338
220
232
246
240
234
244
280
242
282
260
236
270
264
250
248
224
254
248
258
236
222
264
252
256
254
268
256
232

FIG 11
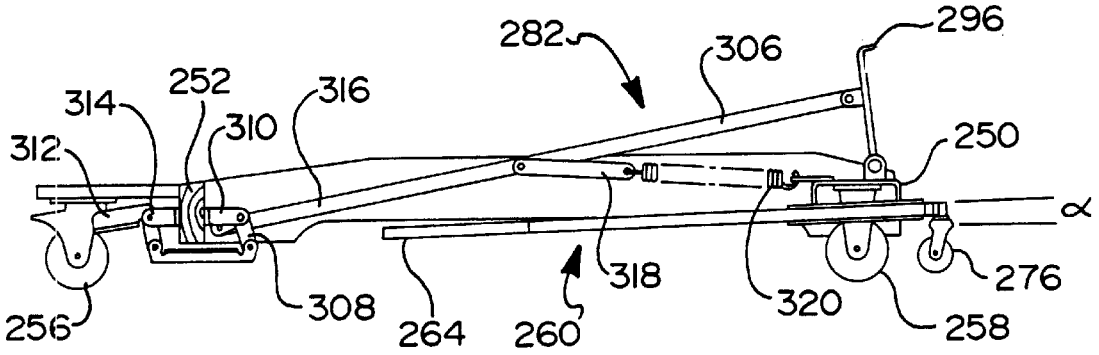
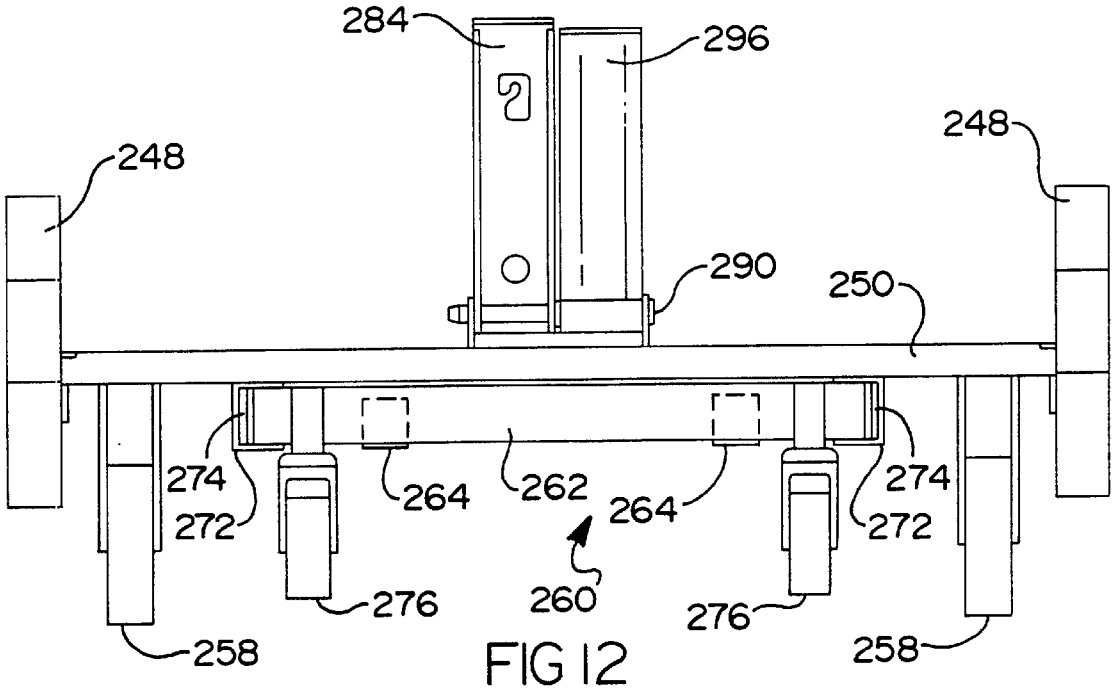
FIG 12

FIG 15
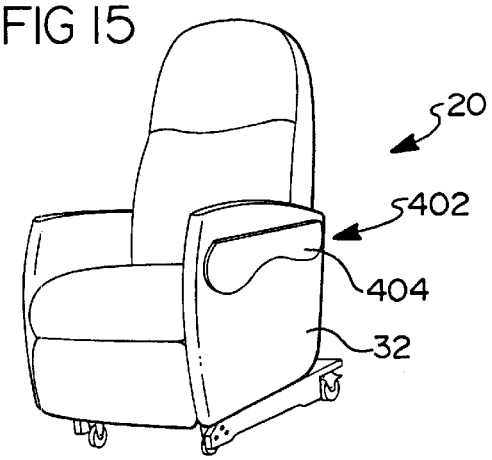
FIG 16
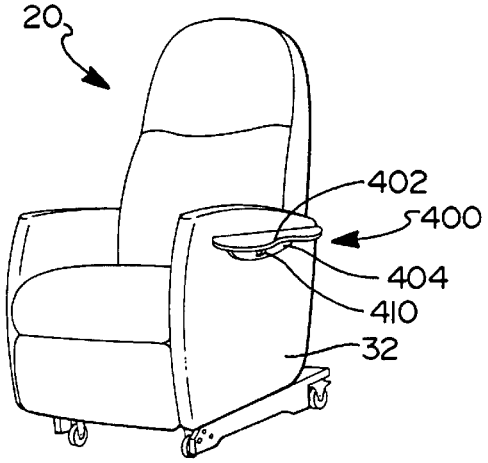
FIG 17
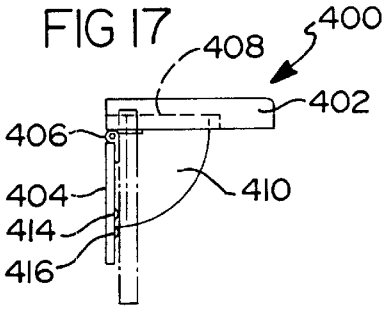
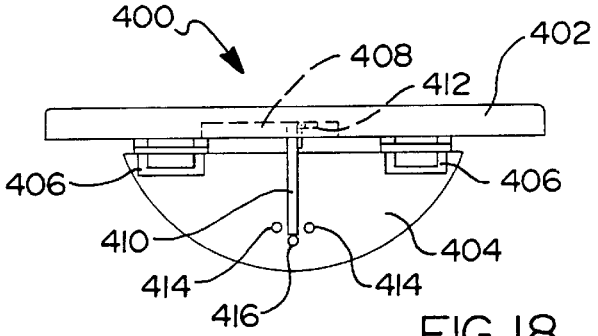
FIG 18
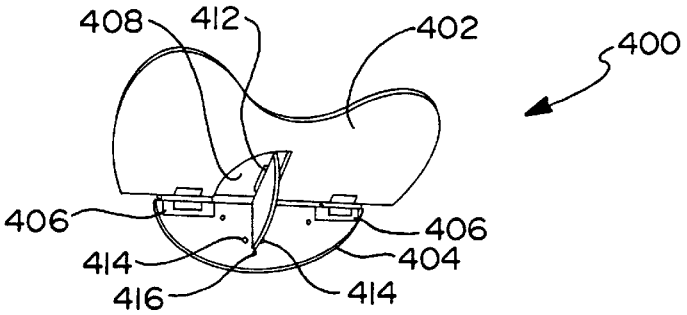
FIG 19

HEALTH CARE RECLINING CHAIR

BACKGROUND OF THE INVENTION

1. Field of the Invention

The present invention relates generally to a reclining chair and, more specifically, to a reclining chair for use in a health care environment having a reinforced chair frame structure and leg rest assembly which is capable of placing a seated occupant into a substantially flat layout position.

2. Description of Related Art

Reclining chairs are widely used in a variety of residential and commercial applications and as such are adapted to provide reclining movement between the seat and seat back assemblies, tilting movement of the chair frame assembly relative to the base assembly, rocking or gliding movement of the chair frame assembly relative to the base frame assembly and extension and retraction of a leg rest assembly. These chairs are capable of placing the seated occupant in an infinite number of seated positions ranging from an upright position to a reclined position.

In this regard, various swing link mechanisms have been utilized for suspending a seat assembly including a seat and seat back within a chair frame for permitting the reclining motion heretofore described. For example, U.S. application Ser. No. 08/319,672 entitled "Recliner Chair Seat Assembly and Method of Upholstering" filed on Oct. 12, 1994 discloses a metal seat assembly having a rear swing linkage and front slide assembly to move the seat assembly between an upright position and a reclined position. However, the range of motion between the metal seat frame and the seat back of this reclining chair is limited to between approximately 95° in the upright position and approximately 150° in the fully reclined position. When adapting a reclining chair for use in the health care environment, it would be desirable to provide a swing link mechanism which is capable of reclining the seat back relative to the seat frame in the range from approximately 95° to approximately 180°, thereby defining a substantially flat occupant-supporting surface.

Likewise, when adapting a reclining chair for use in the health care environment, additional concerns arise regarding the functions and operations of such a reclining chair. For example, in this environment, a chair frame may experience a variety of extreme loading conditions on the side frames, chair arms and seat back when elderly or disabled patients sit down or get up from the reclining chair. Similarly, the reclining mechanisms, tilting mechanisms and leg rest assembly may be loaded in extreme conditions by doctors or visitors leaning or sitting on the chair when it is situated in any of its various positions. Thus, it would be desirable to provide a reclining chair capable of withstanding these adverse loading situations.

Furthermore, when adapting a reclining chair for use in the health care environment, the reclining chair may be utilized as a means of transportation for the seated occupant. Typically, this has been accomplished by adapting a stationary base with a set of wheels such that the reclining chair is mobilized. This modification works adequately when moving the chair from location to location without a seated occupant. However, when the reclining chair is mobilized with a seated occupant therein, the seated occupant's feet may impede the forward mobility of the chair when in the upright position. In this situation, extending the leg rest does not provide an acceptable solution to this problem since it makes directional control of the reclining chair difficult, as well as places the seated occupant, who may be dressed in a hospital gown, in a potentially revealing position. Thus, it is also desirable to provide a mobile base which permits the reclining chair to be transported in a relatively effortless manner, locked into a immobile state, and which further supports the feet of an occupant seated in an upright position during movement of the reclining chair.

As previously mentioned, reclining chairs known in the art have been adapted with a tilt linkage mechanism for tilting the chair frame relative to the base assembly. Typically, these mechanisms are operably coupled to the leg rest assembly and/or the seat assembly such that the chair frame is tilted concomitantly with the reclining motion of the seat back or the extension of the leg rest. However, when adapting a reclining chair for use in the health care environment, it would be desirable to provide a chair frame assembly which may be tilted independent of other motion of the chair to place the seated occupant in an non-reclined, but rearwardly tilted position. Likewise, it would be desirable to place an occupant seated in a reclined position with the leg rest fully extended such that they are lying in a substantially flat position, and further positionable to place their head slightly below their body and legs to increase the flow of blood to the brain for treatment of hypertension or shock conditions.

SUMMARY OF THE INVENTION

In accordance with the principles of the present invention, a reclining chair is disclosed which is adapted for use in the health care environment. As a primary object of the present invention, a health care reclining chair is provided which includes an improved swing link assembly for permitting the seat back assembly to recline to approximately 180° relative to the seat assembly to provide a substantially flat occupant-supporting surface such that the seat back provides a rearwardly extending cantilevered surface and the leg rest assembly provides a forwardly extending cantilevered surface from the chair frame assembly. The swing linkage mechanism includes a pair of front slide assemblies and a pair of rear swing linkage mechanisms which suspend and operably couple the seat assembly to the chair frame for providing the desired reclining motion.

It is another object of the present invention to provide a chair frame assembly, actuation mechanism and leg rest assembly which can be simply and efficiently assembled utilizing an integrated or knock down construction and which is reinforced to provide an extremely rigid structure.

It is an additional object of the present invention to provide a mobile base assembly having a stowable foot tray which permits a seated occupant to be efficiently transported in the health care reclining chair.

It is still another object of the present invention to provide a health care reclining chair having a primary tilt linkage mechanism for tilting the chair frame relative to the base assembly independent of other positioning of the reclining chair.

It is a further object of the present invention to provide a secondary tilt linkage mechanism for tilting the chair frame relative to the base assembly in cooperation with reclining movement of the seat back and/or extension of the leg rest assembly and which is cumulative to the tilting movement of the primary linkage mechanism.

It is yet another object of the present invention to provide a health care reclining chair having an attendant tray fixed to the outer frame assembly thereof which is gravity operated for positioning positionable between a vertical, stowed position and a horizontal, use position.

Additional objects, advantages and features of the present invention will become apparent from the following description and appended claims, taken in conjunction with the accompanying drawings.

DESCRIPTION OF THE DRAWINGS

FIGS. 1A through 1D are perspective views of an exemplary health care reclining chair apparatus showing the various operative positions, including an upright position with the foot tray extended for transporting a seated occupant, an upright position with the leg rest assembly fully extended, a fully reclined position to provide a substantially flat occupant-supporting surface, and a fully reclined position where the chair frame is fully tilted to place a foot rest portion of the leg rest assembly slightly above a head rest portion of the seat back;

FIG. 3 is simplified side sectional view illustrating the mobile frame assembly, chair frame and primary tilt linkage which permits independent tilting of the chair frame relative to the base assembly;

FIG. 4 is a simplified sectional view, similar to that shown in FIG. 3, with the chair frame tilted relative to the base assembly;

FIG. 5 is a simplified sectional view of the improved swing linkage mechanism showing the seat assembly in the upright position in solid lines and in the reclined position in phantom lines;

FIG. 6 is a sectional side view illustrating additional components of the present invention including the reinforcement bracing for interconnecting the front and rear cross-members of the chair frame assembly with the actuation mechanism, the leg rest assembly and the secondary tilt linkage mechanism, wherein the seat back is in the upright position and the leg rest assembly is in the retracted position such that the chair frame is not tilted relative to the base assembly;

FIG. 10 an exploded, detailed view of the front frame cross member of the chair shown in FIG. 9 illustrating a primary and secondary latching mechanism for enabling and disabling the rocking motion of the rocking/reclining chair on the mobile base;

FIG. 11 is a simplified side view of the mobile base assembly shown in FIG. 9 having the secondary latching mechanism and the foot tray assembly in a stowed position;

FIG. 12 is a front view of the base assembly shown in FIG. 11;

FIG. 15 is a perspective view of a reclining chair of the present invention equipped with a retractable attendant tray positioned in a vertical, stowed position;

FIG. 16 is a perspective view of the reclining chair shown in FIG. 15 having the attendant tray positioned in a horizontal use position;

FIG. 17 is a view of the attendant tray looking from the front of the chair in a horizontal use position shown in solid lines and in a vertical stowed position shown in phantom lines;

FIG. 18 is a view of the attendant tray looking from the side of the chair in a horizontal use position shown in solid lines and in a vertical, stowed position shown in phantom lines; and FIG. 19 is a perspective view looking upwardly at the bottom surface of the attendant tray.

DETAILED DESCRIPTION OF THE INVENTION

Figure 2:
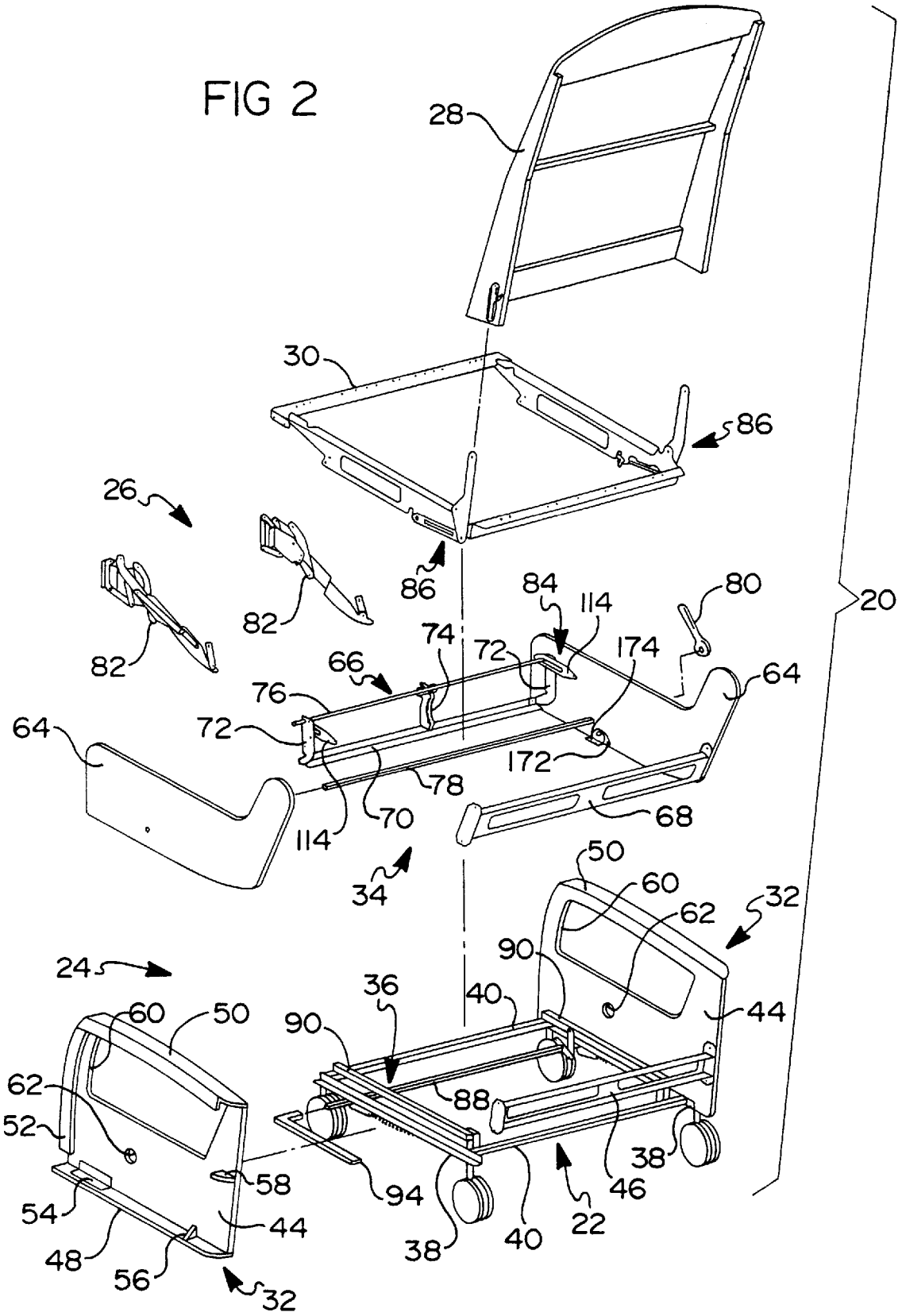
FIG. 2 is an exploded perspective view of a reclining chair of a first preferred embodiment of the present invention with upholstery, springs, and other parts removed from the frame components for illustrating the integrated and interdependent association of these components.

In accordance with the teachings of the present invention, a reclining chair adapted for use in a health care environment is disclosed having a reinforced chair frame assembly and leg rest assembly and which incorporates a swing linkage mechanism to permit the seat back to be reclined approximately 180° relative to the seat. In a first preferred embodiment, the health care reclining chair is provided with a mobile frame assembly having a fixed outer chair frame assembly operatively housing movable inner chair frame assembly. An independent tilting mechanism is interdisposed between the mobile frame assembly and the inner chair frame assembly for tilting the chair frame assembly relative to the base frame assembly. In a second preferred embodiment, the present invention is directed to a combination reclining and platform rocking chair, hereinafter referred to as a reclining/rocking chair. The base assembly of the rocking/reclining chair is adapted with casters for providing a mobile base chair. From the following disclosure, one skilled in the art would readily recognize that the present invention also contemplates the use of other types of motion chairs, such as a wall proximity chair, a glider chair or a stationary rocking chair, in the health care environment. With particular reference now to the drawings, the functional and structural aspects of the present invention are shown.

Referring now to FIGS. 1–8, reclining chair 20 includes mobile frame assembly 22 supporting chair frame assembly 24. Leg rest assembly 26 is positionable between a retracted position as shown in FIG. 1A and an extended position as shown in FIGS. 1B through 1D. A seat assembly including seat back 28 and seat 30 are suspended within chair frame assembly 24 and operably coupled thereto for positioning between an upright position and a fully or "deep" reclined position. As used throughout the specification, "deep recline" refers to the position where seat back 28 is substantially flat with respect to seat 30 such that the angle therebetween is approximately 180° as best seen in FIG. 1C. In the deep recline position, seat back 28 and seat 30 defines a substantially flat occupant-supporting surface which is substantially parallel to the floor surface, and thus provides a bed-like surface. Furthermore, as best seen in FIG. 1D, reclining chair 20 is tiltable relative to mobile frame assembly 22 for changing the angular orientation thereof such that a head rest portion 39 formed at an upper end of seat back 28 is positioned slightly below a foot rest portion 27 formed at a distal end of leg rest assembly 26 when the seat assembly is in the deep recline position and the leg rest assembly is in the fully extended position. As used throughout the specification, the position of an occupant seated in the reclining chair 20 shown in FIG. 1D may be referred to as the "trendelenburg" position.

Referring now to FIGS. 2 through 8, a first preferred embodiment of the present invention is illustrated. Referring to FIG. 2, reclining chair 20 includes mobile frame assembly 22 supporting chair assembly 24 having outer side frame assembly 32 fixedly secured to mobile frame assembly 22 and inner side frame assembly 34 operably coupled to mobile frame assembly 22 by primary tilt linkage mechanism 36. Mobile frame assembly 22 includes a pair of base side rails 38 laterally spaced by a pair of cross members 40 defining a substantially rectangular base frame. Base side rails 38 are preferably formed out of angle iron having a horizontal flange for supporting outer side frame assembly 32 from beneath and a horizontal flange to which outer side frame assembly 32 can be secured. A set of four casters 42 extend downwardly from the corners of mobile frame assembly and are operably coupled thereto such that casters 42 are able to rotate about a vertical axis to enable reclining chair 20 to be easily pushed and steered in any direction. Casters 42 are equipped with a locking feature for disabling the mobility of base assembly 22. Alternately, one skilled in the art would readily recognize that casters 42 could be replaced with stationary leg portions for providing a stationary health care reclining chair similar to the mobile health care reclining chair disclosed as the herein as the first preferred embodiment.

A pair of outer side panels 44 are interconnected and laterally spaced by outer frame cross member 46 to define a C-shaped frame assembly for enclosing inner side frame assembly 34. Outer side frame assembly 32 includes outer side panel 44 having lower frame member 48 extending laterally outwardly from the bottom edge of outer side panel 44, upper frame member 50 extending laterally outwardly from an upper edge of outer side panel 44, and forward frame member 52 disposed along a front edge of outer side panel 44. As best seen in FIG. 2, angle brace 54 and support block 56 are disposed between lower frame member 48 and outer side panel 44 to further stiffen outer frame assembly 32. Additionally, casters 42 are provided with a threaded stud (not shown) which extends upwardly through a clearance hole formed through horizontal flange 38 and is threadingly engaged with a tee nut disposed in a complementary hole formed in lower frame member 48. In this manner, lower frame member 48 is clamped between base side rail 38 and angle brace 54 clamp to provide additional rigidity to outer side panels 44. Contour block 58 is disposed along a rear edge of outer side panel 44 to provide the desirable look and contour to outer side frame assembly 32 when upholstered. Cutout portion 60 formed in outer side panel 44 reduces the weight of reclining chair 20, while providing easier access to the surface underneath upper frame member 50 to facilitate upholstering of outer side frame assembly 32. Clearance hole 62 is formed in outer side panel 44 to allow unobstructed motion of drive rod 78 during tilting movement of inner side frame assembly 34 relative to outer side frame assembly 32.

With continued reference to FIG. 2, inner side frame assembly 34 includes inner side panels 64 interconnected and laterally spaced by front and rear inner frame cross members 66, 68. As presently preferred, front inner frame cross member 66 is a multi-piece assembly including lower cross member segment 70, end member segments 72 extending upwardly opposite lateral ends of cross member segment 70, and central segment 74 provided substantially midway between end member segments 44 and support shaft 76 extending laterally between end member segments 70 and secured to central segment 74. Drive rod 78 is suspended from and operably coupled to inner side panels 64 for rotation therein. Actuation handle 80 is disposed on an end of drive rod 78 to permit rotational manipulation thereof. As presently preferred, front and rear inner frame cross members 66, 68 are formed as metal components and are assembled utilizing a knock down or integrated construction technique. A more detailed description of these components and this construction technique can be found in U.S. Pat. No. 5,435,621 entitled "Modular Reclining Chair and Method" which is commonly owned by the assignee of the present invention and the disclosure of which is expressly incorporated by reference herein.

Inner side frame assembly 34 is operably connected to mobile frame assembly 22 through primary tilt linkage mechanism 36 which includes tilt drive rod 88 supported from base side rails 38 for rotational movement, tilt side rails 90 pivotally coupled to base side rails 38 and tilt linkage 92 operably coupling tilt drive rod 88 to tilt side rails 90. Handle 94 is disposed on an end of tilt drive rod 88 for permitting rotational manipulation thereof to actuate primary tilt linkage mechanism 36. As presently preferred, handle 94 is provided with a sleeve portion extending laterally inward to slidingly receive tilt drive rod 88 such that handle 94 may be disposed beneath chair frame assembly 24 when not in use. Handle 94 is also provided with a stop member (not shown) to prevent separation of handle 94 from drive rod 88.

Referring now to FIGS. 3 and 4, the components and operation of primary tilt linkage mechanism 36 are further illustrated. Tilt side rail 90 is operably coupled to base side rails 38 at support 96 for pivotal movement about pivot 98 in response to actuation of tilt linkage 92. Tilt linkage 92 includes a pair of linkage assemblies each having drive link 100 secured to tilt drive rod 88 for rotation therewith. Tilt link 102 is pivotally connected to tilt side rail 90 at pivot 104 and pivotally connected to drive link 100 at pivot 106 such that a forward edge of tilt link 102 engages tilt drive rod 88 for defining a positive stop for tilt linkage 92. Tilt linkage 92 further includes a toggle mechanism for providing a mechanical assistance to tilt linkage 92. More specifically, the toggle mechanism includes toggle drive link 108 secured to tilt drive rod 88 for rotation therewith, linear spring 110 secured to rear base cross member 40 and extending forwardly therefrom, and toggle link 112 interconnecting toggle drive link 108 with spring 110 such that counterclockwise rotation of tilt drive rail 88 positions pivot 106 in an overcenter condition relative to pivots 98 and 104 to urge tilt linkage mechanism into a tilted position.

As seen in FIG. 3, primary tilt linkage mechanism 36 is in a lowered position such that the angular orientation of outer side frame assembly 32 and inner side frame assembly 34 correspond. In this position, toggle link 112 is in an overcenter condition so as to urge tilt drive rod 88 in a clockwise direction and thus maintain primary tilt linkage mechanism in the forward or non-tilted position. Chair support bracket 142 extends rearwardly from lower cross member segment 70 and has foot portion 144 extending downwardly to engage front base cross member 40 to define a mechanical stop in the non-tilted position which transfers load applied to seat 30 through front inner frame cross member 66 and stop member 142 into base assembly 22. As presently preferred, foot member 144 is made from an elastic material for allowing compression loading of the various joints and pivotal connections in reclining chair 20, thereby relieving the loads applied to drive rod 76.

Referring now to FIG. 4, tilt drive rod 88 has been rotated in the counterclockwise direction causing drive link 100 and tilt link 102 to urge the front portion of tilt side rails 90 upwardly so as to rotate about pivot 98 and cause inner side frame assembly 34 to tilt relative to outer side frame assembly 32 and base assembly 22. As drive rod 88 is rotated in the counterclockwise direction, toggle link 112 passes through an overcenter condition so as to provide mechanical assistance during the tilting actuation of primary tilt linkage mechanism 36. Drive link 100 and tilt link 102 continue to rotate side rails 90 about pivot 98 until a front edge of tilt link 102 below pivot 106 engages drive rod 88 to define a positive mechanical stop. As presently preferred, primary tilt linkage mechanism 36 provides approximately 7° of rearward tilt of inner side frame assembly 34 relative to outer side frame assembly 32 as indicated at $\beta_1$ in FIG. 4.

Referring now to FIG. 5, seat 30 and swing linkage mechanism 86 of the present invention illustrates the range of reclining motion achieved between seat back 28 and seat 30. As presently preferred, seat 30 is of the type disclosed in U.S. Ser. No. 08/319,672 entitled "Recliner Chair Seat Assembly And Method Of Upholstering" filed on Oct. 12, 1994, which is commonly assigned to the assignee of the present invention and the disclosure of which is hereby expressly incorporated by reference herein. Metal seat frame 30 is well-suited for use in the health care environment in that a seat cushion (not shown) can be quickly and easily replaced should it become damaged or soiled during use. Furthermore, metal seat 30 is readily adaptable to a wide range of cushion thicknesses which permit a wide range of seat heights to be accommodated. This is particularly advantageous in the health car environment where a relatively high seat height is desirable to facilitate getting into and out of the reclining chair.

With continued reference to the figures, seat 30 is supported at a forward portion by support shaft 76 and at a rearward portion by inner side panel 64. More specifically, the side rails of seat 30 are adapted to receive front slide assembly 84 which includes front slide bracket 114 having lost motion slot 116 formed therein for guiding the fore and aft motion of seat 30 on support shaft 76. Lost motion slot 116 is of sufficient length to permit a full range of travel for seat 30 during reclining motion thereof and accordingly does not function as a mechanical stop. Rear swing linkage mechanism 86 includes rear attachment link 118 secured to inner side panel 64, rear swing link 120 pivotally connected at a first end to attachment link 118 and operably coupled to seat 30. Likewise, an upstanding post formed on the rear portion of seat 30 is pivotally connected at pivot 122 to rear swing link 120. In addition, rear swing link 120 is operably connected to seat 30 through rear slide mechanism 124. As best seen in FIG. 2, seat back 28 is releasably secured to an upper portion of rear swing link 120.

The geometry of rear swing link 120 permits seat back 28 to be reclined into a substantially flat position relative to seat 30. More specifically, as seat back 28 is reclined relative to seat 30, rear swing link 120 rotates about pivot 122 causing the rear portion of seat 30 to move forwardly and upwardly about an arcuate path defined by pivot 122 (shown in FIG. 5 as $A_1$). As seat 30 moves upwardly and forwardly, front slide brackets 114 slides upwardly and forwardly on support shaft 76. In order for the seat assembly to achieve a substantially flat position, the geometry of rear swing link 120 must be such to allow pivot 126 to achieve an overcenter condition relative to a line drawn between pivot 122 and front support shaft 76. Furthermore, the kinematics of swing linkage mechanism 86 are such that the arc, $A_1$, is tangential with, or in the alternative does not intersect with an arc drawn about the centerline of support shaft 76 through pivot 126 (shown in FIG. 5 as $A_2$) when the seat assembly is in the fully reclined position. In this manner, swing linkage mechanism 86 function as a sliding-block linkage mechanism to permit a full range of motion of seat 30 relative to rear swing link 120.

Rear slide mechanism 124 is operably coupled between rear swing link 120 and seat 30 to define a deep recline limit of the reclining movement of the seat assembly position. More specifically, slide member 128 is pivotally coupled to a lower end of rear slide link 120 and has elongated slot 130 formed therein. Retainer 132 disposed within the slot 130 is secured to seat 30 such that slide 128 reciprocates relative thereto. When seat back 28 reaches the deep recline position, retainer 132 engages the rear portion of slot 130 to provide a positive mechanical stop, thus limiting further reclining motion of seat back 28 relative to seat 30. In addition, rear slide mechanism 124 may be adapted to provide an adjustable frictional resistance to reclining movement of seat back 28 relative to seat 30. The upright limit of reclining movement of the seat assembly is defined by the engagement of a rearward edge of rear swing link 120 with rear inner cross member 68 as best seen in FIG. 6.

With continued reference to FIG. 6, reinforcement bracing 134 is interconnected between drive rod 78 and front and rear inner cross members 66, 68 and includes a pair of laterally spaced drive shaft supports which are journally connected to drive rod 78 and extend forwardly to front inner frame cross member 68 and rearwardly to rear inner frame cross member 68. More specifically, front drive rod support 138 is journally connected to drive rod 78 at a rear end thereof and rigidly secured to a middle portion of corresponding front support arm 140 while front support arm 140 extends between a top portion of support shaft 76 and front cross member segment 70. In addition, reinforcement bracing 134 include rear drive shaft support 146 having a forward end journally connected to drive rod 76 and a reward end rigidly secured to a lower flange of rear inner frame cross member 68. In this manner, reinforcement bracing 134 ties front and rear cross frame members 66, 68 with drive rod 28 to further strengthen and stiffen inner side frame assembly 34 of reclining chair 20. A more detailed description of the components of reinforced bracing 134 can be found in U.S. application Ser. No. 08/552,614 entitled "Linear Actuation Drive Mechanism For Power-Assisted Chairs" filed on Nov. 3, 1995 which is commonly owned by the assignee of the present invention and the disclosure of which is expressly incorporated by reference herein.

Figure 7:
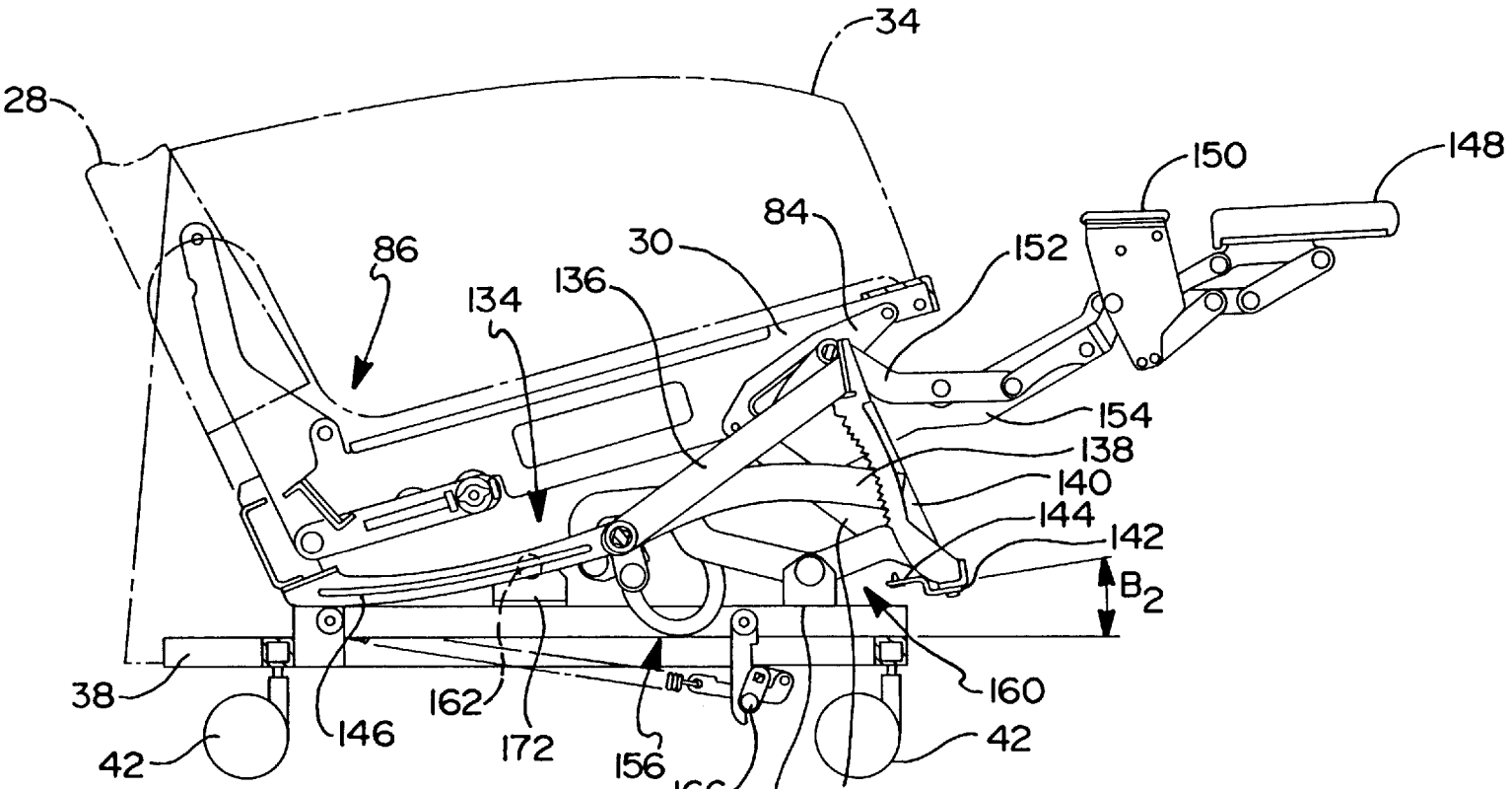
FIG. 7 is a simplified sectional view similar to FIG. 6 illustrating the seat back in the upright position and the leg rest assembly in the extended position such that the chair frame assembly is tilted relative to the base assembly.
Figure 8:
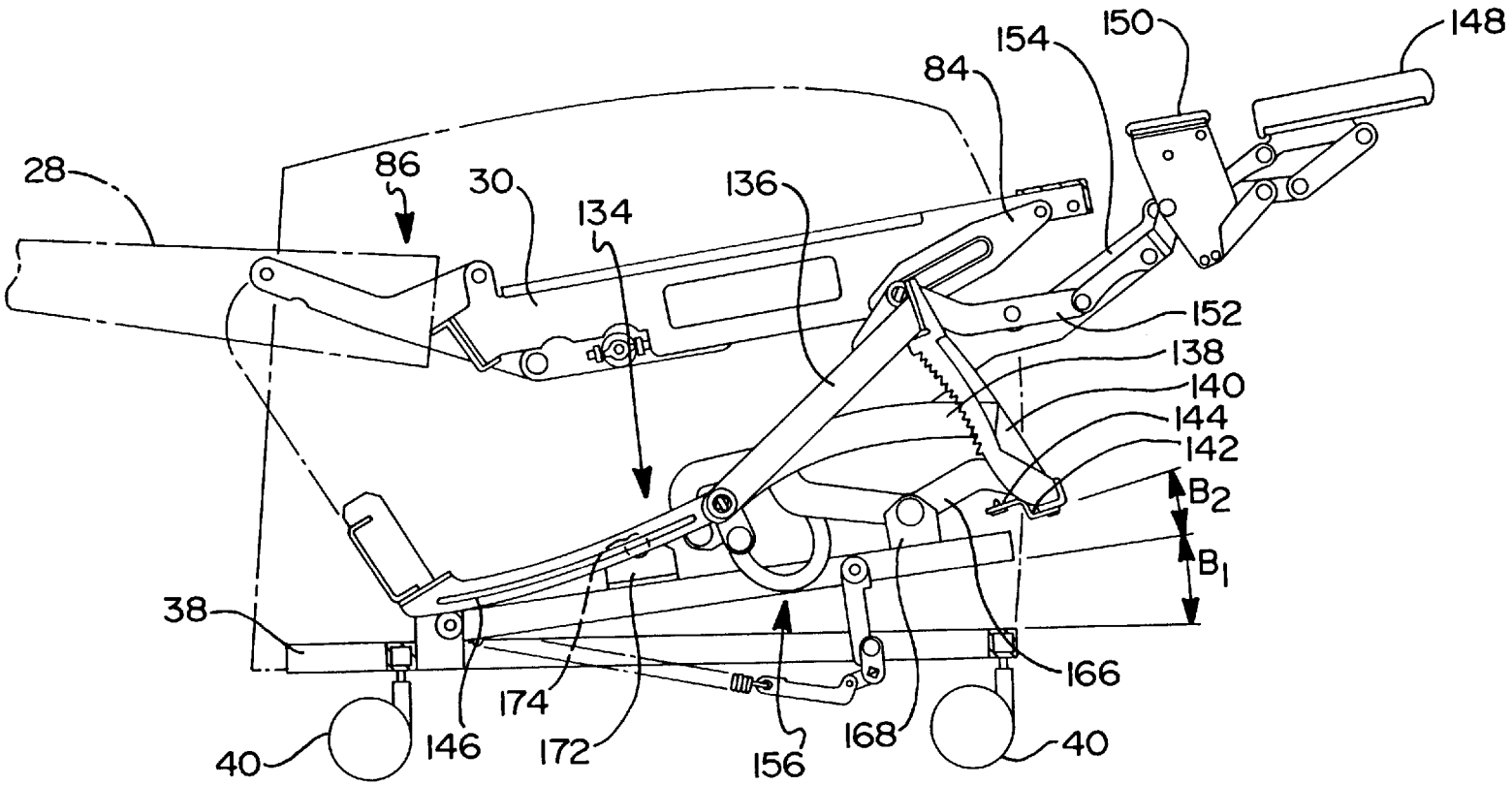
FIG. 8 is a simplified sectional view similar to FIG. 7 illustrating the chair frame with the seat back in a fully reclined position and the leg rest assembly extended such that the chair frame is tilted by the primary and secondary tilt linkage.

With reference to FIGS. 6, 7 and 8, leg rest assembly 26 of reclining chair 20 is illustrated and includes pantograph linkage 82 having leg rest board 148 and ottoman board 150 secured to a portion thereof. Pantograph linkage 82 is journally supported from support shaft 76 by curved swing link 152 and operably coupled to drive rod 78 through long support link 154. As presently preferred, long support link 154 is designed to transfer very heavy loads resulting from a person leaning or sitting on leg rest board 148 or ottoman board 150 through pantograph linkage 82 into drive rod 78. These heavy loads are transferred into inner chair frame assembly 34 by reinforcement bracing 134 which prevents undesirable deformation of drive rod 78. Leg rest assembly 26 is positionable from a retracted position as shown in FIG. 6 into an extended position as shown in FIGS. 7 and 8 through the manipulation of drive rod 78. Leg rest assembly 26 further includes a spring-assist toggle assembly 156 which cooperate with pantograph linkage 82 to facilitate protraction and retraction of leg rest assembly 26.

Leg rest board 148 is readily adaptable to receive various upholstering and/or cushions to match the cushion thickness and seat height utilized with seat 30 for placing a seated occupant in a comfortable position when leg rest assembly is in the extended position. In contrast, ottoman panel 150 is stowed behind leg rest board 148 when leg rest assembly is in the retracted position, and thus is not readily adaptable to receive various upholstering and/or cushion thickness. However, height adjustment of ottoman board 150 may be accommodated with an ottoman linkage having a selectable height feature. A presently preferred leg rest assembly is disclosed in U.S. application Ser. No. 08/659,798 entitled "Dual Leg Rest Assembly Having Selectable Height Ottoman" filed on Jun. 7, 1996 which is commonly owned by the assignee of the present invention is preferred and the disclosure of which is expressly incorporated by reference herein.

With continued reference to FIGS. 6 through 8, secondary tilt assembly 160 is interconnected between tilt side rail 90 and seat 30 for tilting inner side frame assembly 34 relative to primary tilt linkage mechanism 36, i.e., rotating inner side frame assembly 34 about pivot point 162. Secondary tilt assembly 160 further includes main pivot brackets 172 attached to base side rails 38 and main pivot mount 174 secured to an inner surface of inner side panels 64 for pivotally connecting inner side frame assembly 34 to tilt side rail 90 of primary tilt linkage mechanism 36. Secondary tilt assembly 160 is operably coupled to front slide assembly 84 for causing tilting movement in response to reclining movement of seat back 28 relative to seat 30 and includes a generally straight lift link 164 pivotally connected at a rear portion of front slide bracket 114 at an upper end thereof and pivotally connected to lift lever 166 at a lower end thereof. Secondary tilt assembly 160 is also operably coupled to drive rod 78 for causing tilting movement in response to rotation thereof, and further includes lift lever 166 pivotally connected at pivot point 168 intermediate the first and second ends thereof to front pivot bracket 170 which is secured to tilt side rails 90. The second end of lift lever 166 is operably coupled to drive rod 78 such that rotation thereof causes tilting movement of inner side frame assembly 34.

Referring to FIG. 6, reclining chair 20 is illustrated in a non-tilted, non-reclined position such that seat 30 is supported by support shaft 76 by main pivot bracket 172. Referring now to FIGS. 7 and 8, tilting movement is induced as seat back 28 is reclined with respect to seat 30. Lift link 164 rotates about its pivotal connection in a clockwise direction to urge the front of inner side frame assembly 34 upward so as to tilt about pivot point 174. Additional tilting of the inner side frame assembly 34 can be achieved by rotation of drive rod 78 in a counterclockwise direction which rotates lift lever 166 in a counterclockwise direction about bracket pivot 168 to urge lift link 164 in an upwardly direction, thereby further tilting inner side frame assembly 34 relative to primary tilt linkage mechanism 36. Secondary tilting mechanism 160 is further described in U.S. application Ser. No. 08/533,829 entitled "Glider Chair" filed on Oct. 18, 1995 which is commonly owned by the assignee of the present invention and the disclosure of which is expressly incorporated by reference herein.

The total tilting movement effectuated by reclining seat back 28 and actuation of drive rod 78 is the sum tilting movement achieved by each independent tilting movement heretofore described. As presently preferred, the tilting movement of inner side frame assembly 34 effectuated by reclining of seat back 28 is approximately 3° (not shown independently), and the tilting movement of inner side frame assembly effectuated by rotation of drive rod 78 is approximately 6° as indicated as $\beta_3$ in FIG. 7. Accordingly, secondary tilt assembly 160 enables reclining chair 20 to be independently and cumulatively tilted a total of approximately 9° as indicated as $\beta_2$ in FIG. 7. Furthermore, primary tilt linkage mechanism 36, which provides approximately 7° of tilt between inner side frame assembly 34 and mobile frame assembly 22 as indicated by $\beta_1$ in FIG. 8, is independent of and cumulative with the tilting movement achieved by secondary tilt assembly 160. Accordingly, primary tilt linkage mechanism 36 and secondary tilt assembly 160 enables reclining chair 20 to be independently and cumulatively tilted a total of approximately 16°. Thus, as best seen in FIG. 8, actuation of primary tilt linkage mechanism 36 and secondary tilt assembly 160, in combination with deep recline swing linkage mechanism 86, enables a seated occupant to be laid in a substantially flat position parallel with the floor or inclined thereto such that their head is positioned slightly below their feet in a trendelenburg position.

The first preferred embodiment of the present invention has been described with particular reference to a motion chair of the reclining type. However, one skilled in the art should readily recognize that the present invention is adaptable for use in other types of motion chairs. More specifically, primary tilt linkage mechanism 36, the swing linkage assembly including front slide assembly 84 and rear swing linkage mechanism 86, and reinforcement bracing 134 as disclosed herein are readily adaptable for use in a wall proximity chair of the type disclosed in U.S. application Ser. No. 08/429,104 entitled "Wall Proximity Reclining Chair" filed on Apr. 26, 1995, which is commonly owned by the assignee of the present invention and the disclosure of which is expressly incorporated by reference herein. While the wall proximity chair disclose in U.S. application Ser. No. 08/429,104 is described with particular reference to a reclining chair having a wooden seat and a swing link mechanism adapted therefor, one skilled in the art would readily recognize that the invention disclosed therein is adaptable to include a metal seat assembly with certain changes, modifications and/or adaptations to the rear swing linkage mechanism without departing from the spirit and scope of the present invention. Likewise, the present invention is equally adaptable to a motion chair having a wooden seat assembly with certain changes, modifications and/or adaptations to the rear swing linkage mechanism without departing from the spirit and scope thereof.

Figure 9:
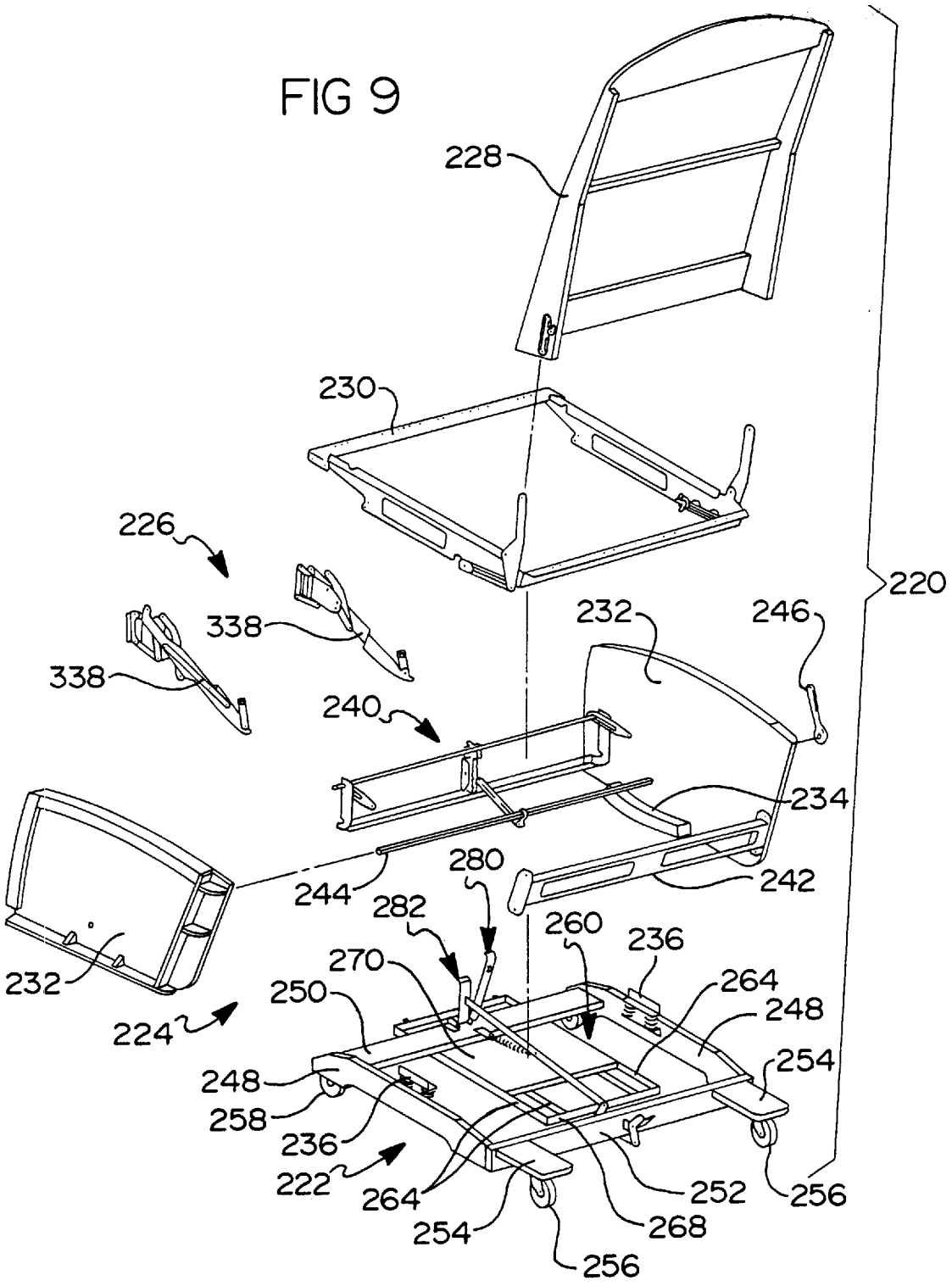
FIG. 9 is an exploded perspective view of a rocking/reclining chair of a second preferred embodiment of the present invention which is adapted for use in a health care environment having upholstery, springs, and other parts removed from the frame components for illustrating the integrated and interdependent association of these components.

Likewise, the present invention is readily adaptable into a glider chair of the type disclosed in U.S. application Ser. No. 08/533,829 previously incorporated by reference herein. Referring now to FIGS. 9 through 14, a second preferred embodiment of the present invention is illustrated. While the second preferred embodiment is generally described with reference to a mobile base rocking/reclining chair, one skilled in the art would readily recognize that the present invention is equally adaptable for use in a stationary rocker. Referring now to FIG. 9, rocking/reclining chair 220 includes mobile base assembly 222, chair frame assembly 224, leg rest assembly 226 and a seat assembly having seat back 228 and seat 230. Chair frame assembly 224 is operably coupled to mobile base assembly 222 for rocking movement thereon. More specifically, side frame panel 232 receives contoured rocker block 234 on a lower inner surface thereof. The bottom surface of rocker block 234 is curved and engages an upper surface of mobile base assembly 222 to permit rocking movement of chair frame assembly 224 thereon. Preferably, rocker block 234 is interconnected to base assembly 222 by double coil spring rocker assembly 236 for permitting balanced rocking movement of chair frame assembly 224 with respect to base assembly 222 and further for urging chair frame assembly 224 into a substantially upright neutral position. Spring rocker assembly 236 further provides a limit for rearward and/or forward rocking movement of chair frame 224 relative to base assembly 222. A presently preferred design of spring rocker assembly 236 is disclosed in U.S. application Ser. No. 08/322,788 entitled "Rocking/Reclining Chair Having Limit Means and Noise Suppression Means" filed on Oct. 13,1995 which is commonly owned by the assignee of the present invention and which is expressly incorporated by reference herein.

Chair frame assembly 224 includes side frame panel 232 interconnected and laterally spaced by front and rear frame cross members 240, 242. As presently preferred, front frame cross member 240 is a multi-piece assembly identical to front inner frame cross member 66 described previously with reference to the first preferred embodiment of the present invention and includes support shaft 328. Drive rod 244 is suspended from and operably coupled to side frame panel 232 for rotation therein. Actuation handle 246 is disposed on an end of drive rod 244 to permit rotational manipulation thereof.

With continued reference to the figures, mobile base assembly 222 includes base side rails 248 interconnected and laterally spaced by front and rear base cross members 250, 252 to define a substantially rectangular base assembly. A pair of rearwardly extending flanges 254 are secured to rear base cross member 252 and receive a pair of rear casters 256. Likewise, front casters 258 are secured to a bottom surface of front base frame cross member 250 for mobilizing base assembly 222. As presently preferred, front casters 258 are secured to base assembly 222 so that the wheels thereof do not rotate about a vertical axis. In contrast, rear casters 256 are capable of rotating about a vertical axis to facilitate steering of chair 220 on mobile base assembly 222. Furthermore, rear casters 256 include a locking feature which disables the mobile aspect of base assembly 222.

Mobile base assembly 222 may further optionally include foot tray assembly 260 which provides a pullout surface in front of and below seat 230 when rocking/reclining chair 220 is in the upright position with leg rest assembly 226 retracted. Thus, foot tray assembly 260 allows the feet and legs of a seated occupant to rest on a portion of mobile base assembly 222 during transportation without impeding the mobility of chair 220 or requiring extension of leg rest assembly 226. Foot tray assembly 260 includes rectangular foot tray frame 262 having support rails 264 laterally spaced by front and rear cross members 266, 268. Foot tray board 270 is disposed within and supported by foot tray frame 262. As presently preferred, the upper surface of foot tray board 270 has a non-slip surface thereon to provide additional safety. Foot tray frame 262 is suspended from mobile base assembly 222 by a pair of C-shaped foot tray brackets 272 secured to a lower surface of front base cross member 250. With particular reference to FIG. 12, nylon inserts 274 are disposed within foot tray bracket 272 which receives foot tray frame 262 to facilitate sliding movement therein. In this way, foot tray frame 262 and foot tray board 270 are extendable and retractable from mobile base assembly 222 in a pullout manner. A pair of casters 276 are secured to the front edge of front cross member 268 to support front tray assembly 260 in the extended position. In addition, as best seen in FIG. 11, foot tray frame 262 is angularly oriented with respect to mobile base assembly 222 in a forwardly and upwardly direction as indicated by the angle $\alpha$ which is approximately 3°. The angular orientation of foot tray assembly 260 facilitates manipulation of mobile base assembly 222 by eliminating a point of contact between the floor and casters 276 when foot tray assembly 260 is unloaded or lightly loaded.

Figure 13:
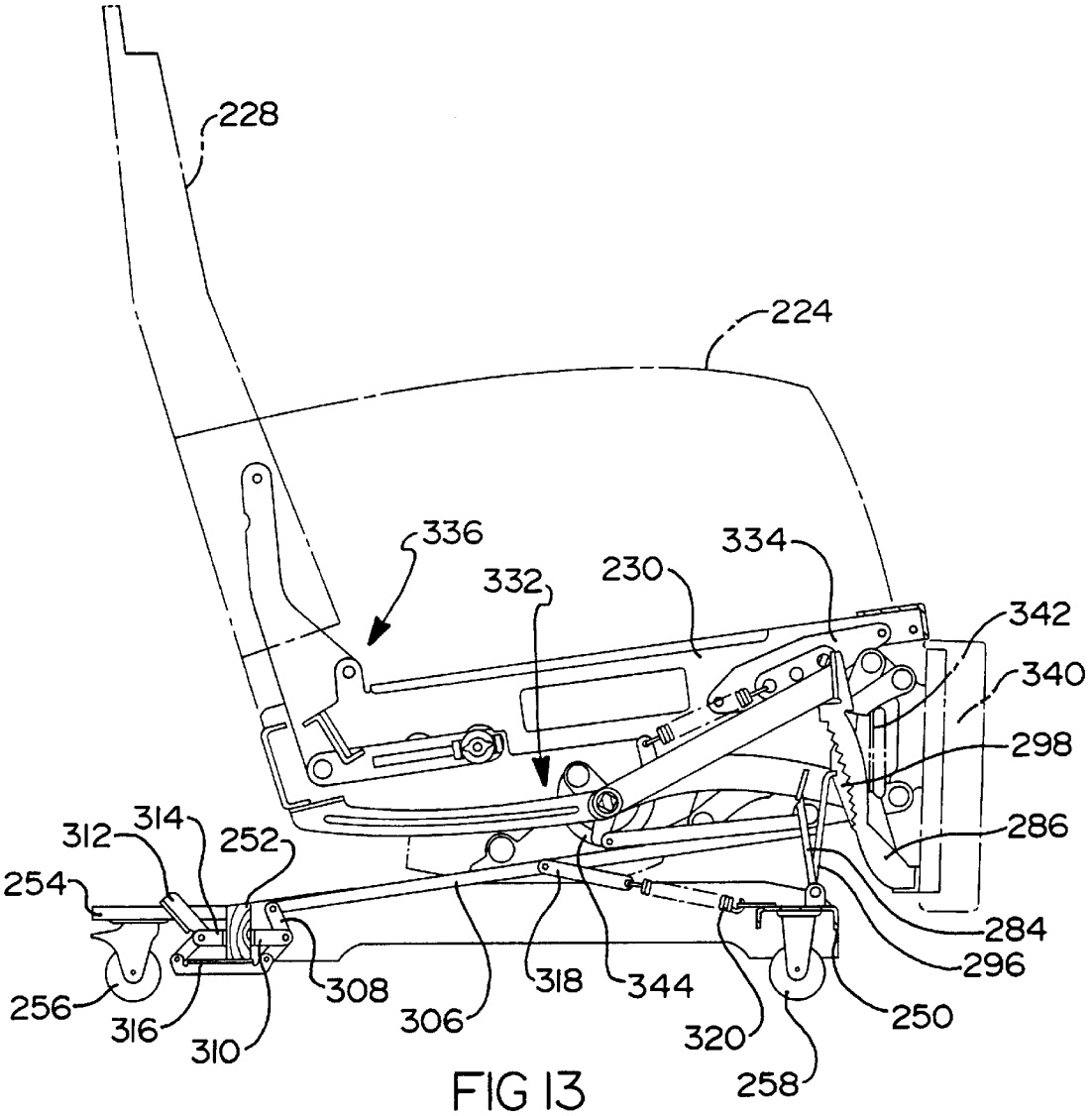
FIG. 13 is a simplified side view of the rocking/reclining chair in a transportation mode showing the secondary pawl engaging the secondary racket plate to lock the chair frame in the upright position.
Figure 14:
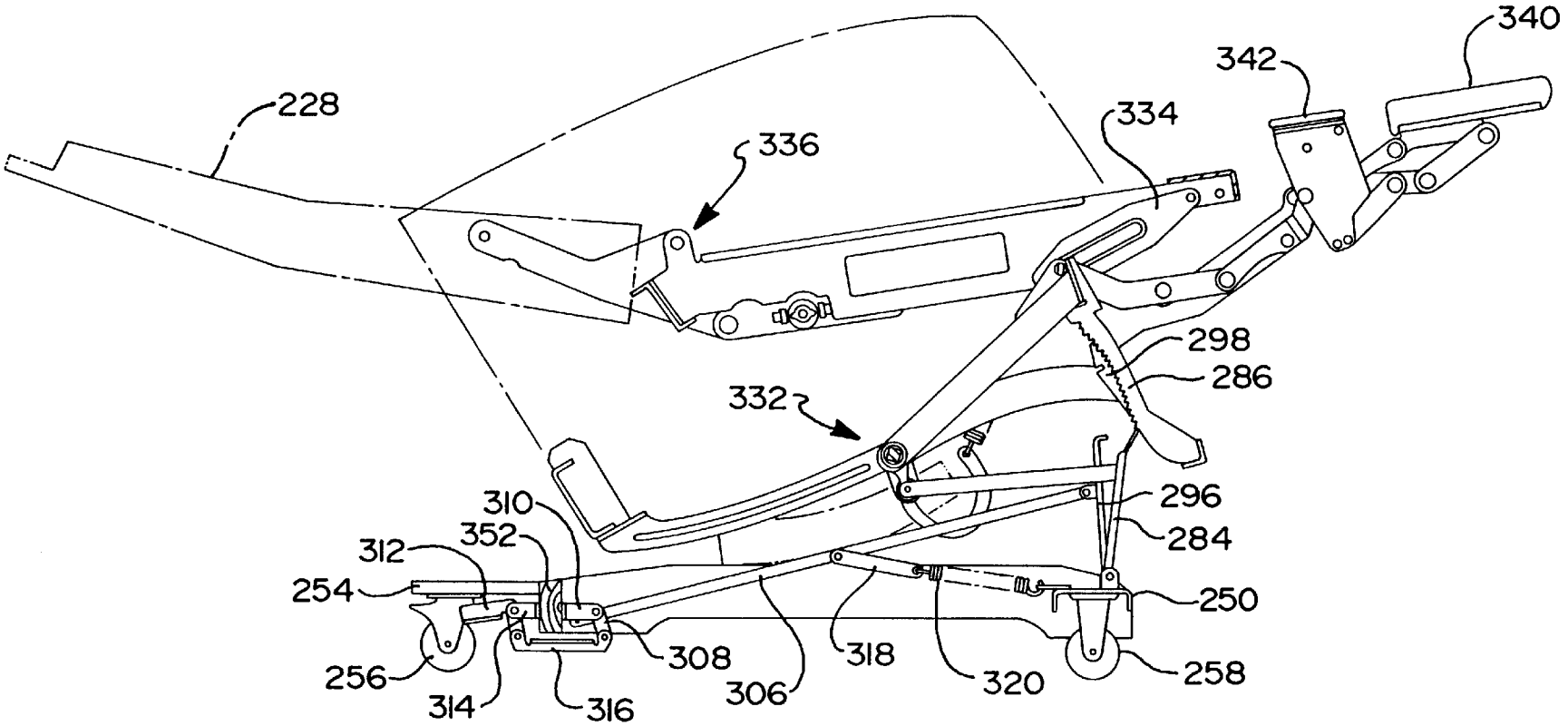
FIG. 14 is a simplified sectional side view similar to that shown in FIG. 13 illustrating the seat assembly in a fully reclined position, the leg rest assembly in an extended position to provide a substantially flat occupant-supporting surface and the chair frame tilted rearwardly such that the primary pawl engages the primary racket sector to place a head rest portion of the seat back slightly below a foot rest portion of the leg rest assembly.

Mobile base assembly 222 also includes primary latching mechanism 280 and secondary latching mechanism 282 pivotally connected to front base cross member 250 on an upper surface thereof. As best seen in FIGS. 13 and 14, primary latching mechanism 280 includes primary pawl 284 and arcuate ratchet sector 286 formed on a central member of front frame cross member 240. A plurality of teeth 288 are formed on the arcuate surface of primary ratchet sector 286. Primary pawl 284 is pivotally positionable about pin 290 with respect to ratchet teeth 288 between a disengaged (released) position as shown in FIG. 13 for permitting normal rocking action of chair 220, and an engaged (locked) position as shown in FIG. 14 for positioning chair frame assembly 224 in a rearwardly tilted orientation while inhibiting subsequent rocking movement of chair 220. Primary pawl 284 is urged forwardly or biased towards primary ratchet 286 by torsional spring 292. Primary latching mechanism 280 further includes release member 294 which operably interconnects primary pawl 284 with drive rod 244 such that primary pawl 284 is disengaged from primary ratchet sector 286 when drive rod 244 is in its clockwise-most position as seen in FIGS. 13 and 14. As drive rod 244 is rotated counterclockwise, primary latching mechanism 280 permits primary pawl 284 to pivot into engagement with primary ratchet sector 286 for placing chair 220 in the locked position. Upon subsequent clockwise rotation, release member 294 pivots primary pawl 284 out of engagement from primary ratchet sector 286, thus enabling rocking movement of chair 220. A presently preferred primary latching mechanism is further disclosed and illustrated in U.S. application Ser. No. 08/322,789 entitled "Pawl and Ratchet Assembly" filed on Oct. 13, 1994 which is commonly owned by the assignee of the present invention and the disclosure of which is expressly incorporated by reference herein.

Secondary latching mechanism 282 is provided on mobile base assembly 222 for locking out the rocking motion of chair 220 during mobile transportation thereof. Referring now to FIGS. 10 and 11, secondary latching mechanism 282 includes secondary pawl 296 pivotally connected through pin 290 to an upper surface of front base cross member 250 and biased by torsional spring 292. Secondary ratchet plate 298 have a pair of rearwardly tapered edges formed thereon that terminate at a notch and is secured to and extends from primary ratchet sector 286. More specifically, a pair of apertures 300 are formed through the sidewalls of primary ratchet sector 286 and receive threaded fasteners 302. Secondary ratchet plate 298 is positioned laterally outboard of primary ratchet sector 286 by spacer bushings 304. As presently preferred, threaded fasteners 302 extend through both walls of primary ratchet sector 286 shown in FIG. 10. Secondary pawl 296 is pivotally positioned into engagement with the notch formed in secondary ratchet plate 298 for locking out the rocking motion of chair frame 224 similar to that described with respect to primary latching mechanism 280.

Secondary latching mechanism 282 includes a linkage mechanism for selectively positioning secondary pawl 296. More specifically, as best seen in FIG. 11, the linkage mechanism includes release link 306 pivotally connected at a first end to secondary pawl 296 and pivotally connected at a second end to rocker link 308 which is secured to a forward surface of rear base cross member 252 by rocker bracket 310 for pivotal motion thereon. Similarly, drive link 312 is pivotally coupled to a rearward surface of rear base cross member 352 by drive bracket 314. Follower link 316 interconnects a lower portion of drive link 312 with a lower portion of rocker link 308. A rearwardly extending portion of drive link 312 is utilized as an actuation pedal for secondary latching mechanism 282. As best seen in FIG. 13, application of an upward force on the actuation pedal causes drive link 312 to rotate in a clockwise direction which pulls follower link 316 rearwardly resulting in a concomitant clockwise rotation of rocker link 308 which urges release link 306 forwardly to allow secondary pawl 296 to engage the notch formed in secondary ratchet plate 296, thereby disabling rocking movement of chair frame assembly 224. As best seen in FIG. 14, to disengage secondary pawl 296, a downward force is applied to the rearward extending portion of drive link 312 which results in release link 306 pulling secondary pawl 296 rearwardly out of engagement from secondary ratchet plate 298. Assist link 318 is pivotally coupled to a mid-portion of release link 306 at a first end thereof and is attached to assist spring 320 at a second end thereof. Assist spring 320 extends from a second end of assist link 318 to front base cross member 250 for providing mechanical assistance to the actuation of secondary latching mechanism 282.

Referring now to FIGS. 13 and 14, adaption of certain aspects described in connection with the first preferred embodiment are briefly described in connection with chair 220. For example, chair 220 includes reinforcement bracing 322 interconnected between drive rod 244 and front and rear frame cross member 240, 242 which is substantially similar to reinforcement bracing 134 described and illustrated with respect to the first preferred embodiment of the present invention. More specifically, a pair of lateral spaced drive shaft supports are generally connected to drive rod 244 and extend forwardly to front frame cross member 240 and rearwardly to rear frame cross member 242. Front drive rod support 324 is journally connected to drive rod 244 at a rear end and rigidly secured to a middle portion of corresponding front support arm 326 which is secured at an upper end to support shaft 328 and at a lower end to front cross member segment 230. In addition, reinforcement bracing 322 includes rear drive rod support 332 having a forward end journally connected to drive rod 244 and a rearward end rigidly secured to a lower flange of rear frame cross member 242.

Likewise, the swing linkage mechanism of chair 220 is identical to the swing linkage mechanism described with respect to the first preferred embodiment and includes front slide assembly 334 and rear swing linkage mechanism 336. As previously described, the geometry of front slide assembly 334 and rear swing linkage mechanism 336 permits seat back 228 to be reclined into a substantially flat position relative to seat 230.

Similarly, leg rest assembly 226 of chair 220 is substantially identical to leg rest assembly 26 of the first preferred embodiment of the present invention and includes a pair of pantograph linkages 338 having leg rest board 340 and ottoman board 342 secured to a portion thereof. Pantograph linkage 338 is operably coupled between support shaft 328 and drive rod 224 so as to be positionable from a retracted position as shown in FIG. 13 into an extended position as shown in FIG. 14 through the manipulation of drive rod 244. Leg rest assembly 226 further includes spring assist toggle assembly 344 which cooperates with pantograph linkage 338 to facilitate protraction and retraction of leg rest assembly 226.

Rocking/reclining chair 220 is positionable through a range of motion from an upright position where the seat assembly is in a non-reclined position and the chair frame assembly is in a neutral, non-tilted position as illustrated in FIG. 13, to a fully reclined position which places a seated occupant in a substantially flat position and a fully tilted or trendelenburg position such that their head is positioned slightly below their feet as best illustrated in FIG. 14. While chair 220 has been described to include mobile base assembly 222, one skilled in the art would readily recognize that a stationary base assembly similar to the base assembly disclosed in U.S. application Ser. No. 08/322,789 entitled "Pawl & Ratchet Assembly" previously identified and incorporated by reference herein could be adapted for use in the present invention.

Referring now to FIGS. 15–19, reclining chair 20 in accordance with the first preferred embodiment is illustrated including fixed outer side frame assembly 32 which allows various medical related equipment, such as trays, I.V. poles, monitoring equipment and the like, to be attached to reclining chair 20 without adversely affecting the reclining or tilting movement thereof. For example, Attendant tray 400 is secured to an upper portion of outer side frame assembly 32 and is positionable between a substantially vertical, non-use position as shown in FIG. 15 and a horizontal, use position as shown in FIG. 16. Attendant tray 400 includes tray top 402 operably coupled to mount bracket 404 for relative rotational motion. More specifically, a pair of hinges 406 are disposed along an upper edge of mount bracket 404 and secure to a bottom surface of tray top 402 along an inboard edge. The bottom surface of tray top 402 also has recessed portion 408 formed therein for receiving brace 410 which is secured thereto by hinge 412. In this manner, brace 410 is received within the bottom surface of tray top 402, thereby permitting tray top 402 to collapse directly against outer side frame assembly 32. As presently preferred, tray top 402 is fabricated out of molded plastic, a suitable wood or coated composite board, while mount bracket 404, hinges 406, brace 410, and hinge 412 are formed out of aluminum. Although it is contemplated that other materials providing the proper structural characteristics could also be utilized.

Mount bracket 404 is secured to outer side frame assembly 32 by threaded fasteners 416 which extend through mount bracket 404 into the side panel. By hingedly securing brace 410 to tray top 402, attendant tray 400 is gravity operated. More specifically, if attendant tray 400 is in the vertical, stowed position, the seated occupant or an attendant therefor merely lifts an outer edge of tray top 402 upwardly so as to rotate tray top 402 about hinges 406. As tray top 402 reaches the horizontal position, gravity urges brace 410 to rotate downward about hinge 412 and into a substantially vertical position to support tray top 402. A pair of protuberances in the of shape hemispherical discs 414 are situated on either side of brace 410 to facilitate manipulation of brace 410 into the proper center position for supporting tray top 402. Attendant tray 400 is easily stowed by again lifting slightly upwardly on tray top 402 to release brace 410 from mount bracket 404 and to clear protuberances 414. Brace 410 is manipulated slightly laterally about hinge 412. Once brace 410 is past a vertical orientation, gravity urges tray top 402 downwardly, thus collapsing brace 410 into recess portion 408 of tray top 402.

Tray top 402 is shaped to facilitate the manipulation of attendant tray 400 while maximizing the usable surface are thereof. More specifically, the forward and rearward portions of tray top 402 is sufficiently sized to provide a usable table top. The center portion of tray top 402 is contoured slightly inward toward reclining chair 20 to enable a occupant seated therein to reach beneath tray top 402 when it is in the horizontal, use position to access brace 410 for placing attendant tray 400 back into the substantially vertical, stowed position.

As can be appreciated from the above disclosure, the present invention is directed to a motion chair which is specifically adapted to and addresses the needs of an article of furniture for use in a health care environment. While the foregoing discussion discloses and describes various exemplary embodiments of the present invention, one skilled in the art will readily recognize from such discussion, and from the accompanying drawings and claims, that various changes, modifications and adaptations can be made therein without departing from the spirit and scope of the invention as set forth in the following claims.

What is claimed is:

1. A reclining chair comprising:

a chair frame including a pair of side frame members interconnected by a rear cross frame member and a front cross frame member having a first shaft;

a seat assembly including a seat back and a seat;

a swing linkage mechanism operably coupling said seat assembly to said chair frame to permit reclining movement of said seat assembly between an upright position and a deep recline position, said swing linkage mechanism including a front slide assembly operably coupled to said first shaft and a rear swing link having a first end pivotally connected at a first pivot to said chair frame and a second end pivotally connected to said seat at a second pivot; and limit means operably connected between said rear swing link and said seat for defining the limits of said reclining movement;

when said seat assembly is in said deep recline position, said swing linkage mechanism being positionable such that said second pivot achieves an over-center condition with respect to a line drawn between said first shaft and said first pivot, whereby said seat back achieves a substantially flat position relative to said seat.

2. The reclining chair of claim 1 further comprising a base assembly supporting said chair frame above a floor surface, said chair frame being operably coupled to said base assembly to permit tilting movement therebetween.

3. The reclining chair of claim 2, further comprising:

said seat back including a head rest portion;

said leg rest assembly including a foot rest portion; and a tilt linkage mechanism operable to place said head rest portion slightly below said foot rest portion when said seat assembly is in said deep recline position.

4. The reclining chair of claim 2 further comprising a tilt linkage mechanism including:

a tilt link secured to said chair frame and pivotally connected at a first end to said base assembly; and a lift linkage including a drive link secured to an actuation rod for rotation therewith and a lift link pivotally connected at a first end to said drive link and pivotally connected at a second end to said tilt link.

5. The reclining chair of claim 4 wherein said tilt linkage mechanism further includes a toggle linkage for providing mechanical assistance during said tilting movement.

6. The reclining chair of claim 2 further comprising a tilt linkage mechanism including:

a pivot assembly operably connected between said chair frame and said base assembly; and a lift link operably connected at a first end to said base assembly forward of said pivot assembly and pivotally connected at a second end to said front slide assembly such that said reclining movement of said seat tilts said chair frame relative to base assembly.

7. The reclining chair of claim 6 wherein said tilt linkage mechanism further comprises:

a drive rod suspended from said chair frame for rotation;

a lift lever bracket secured to said base assembly forward of said pivot assembly;

a lift lever operably coupled at a first end to said drive rod and pivotally connected to said first end of said lift link; and said lift lever being pivotally connected to said lift lever bracket at a point intermediate said first and second ends of said lift lever;

whereby rotation of said drive rod rotates said lift link into an upright position to tilt said chair frame relative to said base assembly.

8. The reclining chair of claim 2 further comprising:

a rocker block secured to a lower portion of said side frame and having a contoured surface for engaging an upper surface of said base assembly to permit rocking movement therebetween; and a rocker spring assembly interdisposed between said rocker block and said base assembly for urging said chair frame into a substantially upright, neutral position.

9. The reclining chair of claim 8 further comprising:

a ratchet secured to said front frame cross member; and a pawl pivotally connected to said base assembly for pivotally positioning between an engaged position with said ratchet to disable rocking movement of said chair frame relative to said base assembly and a disengaged position with ratchet to enable rocking movement of said chair frame relative to said base assembly.

10. The reclining chair of claim 2 wherein said base assembly comprises a set of casters extending therefrom.

11. The reclining chair of claim 10 further comprising a foot tray positionable from a stowed position beneath said chair frame and a use position in front of said chair frame below a front portion of said seat.

12. The reclining chair of claim 1 further comprising:

a drive rod suspended from said chair frame for rotation;

a front reinforcement bracing interdisposed between said drive rod and said front cross frame member; and a rear reinforcement brace interdisposed between said drive rod and said rear cross frame member.

13. The reclining chair of claim 1 further comprising a side table positionable between a stowed position adjacent to and substantially parallel with said side frame member and a use position substantially perpendicular with said side frame member.

14. A health care chair comprising:

a chair frame having a shaft and a seat disposed therein;

a swing link having a first end pivotally connected to said chair frame at a first pivot and a second end pivotally connected to said seat at a second pivot;

a seat back operably coupled to said swing link and positionable between an upright position and a deep recline position such that said second pivot achieves an over-center condition with respect to a line drawn between said shaft and said first pivot when said seat back is in said deep recline position; and a leg rest assembly operably coupled to said chair frame and positionable between a retracted position and an extended position independent of said seat back;

wherein said seat back and said leg rest assembly are operable to be contemporaneously cantilevered from said chair frame in said reclined position and said extended position respectively such that said seat, said seat back and said leg rest assembly define a substantially flat occupant-supporting surface.

15. The health care chair of claim 14 further comprising a base assembly supporting said chair frame above a floor surface, said chair frame being operably coupled to said base assembly to permit tilting movement therebetween.

16. The health care chair of claim 15 further comprising:

said seat back including a head rest portion;

said leg rest assembly including a foot rest portion; and a tilt linkage mechanism operable to place said headrest portion slightly below said foot rest portion when said seat assembly is in said deep recline position.

17. The reclining chair of claim 16 further comprising a tilt linkage mechanism including:

a tilt link secured to said chair frame and pivotally connected at a first end to said base assembly;

a lift linkage including a drive link secured to an actuation rod for rotation therewith and a lift link pivotally connected at a first end to said drive link and pivotally connected at a second end to said tilt link; and a toggle linkage for providing mechanical assistance during said tilting movement.

18. The reclining chair of claim 15 wherein said base assembly comprises a set of casters extending therefrom.

19. The health care chair of claim 14 further comprising:

said chair frame including a pair of side frame members interconnected by a rear cross frame member and a front cross frame member;

a drive rod suspended from said chair frame for rotation;

a front reinforcement bracing interdisposed between said drive rod and said front cross frame member; and a rear reinforcement brace interdisposed between said drive rod and said rear cross frame member.

20. The health care chair of claim 14 further comprising an attendant tray assembly including:

a mount bracket secured to said chair frame;

a tray top hingedly secured along an inboard lateral edge of said tray top to an upper edge of said mount bracket such that said tray top is pivotally positionable from a vertical stored position wherein said mount bracket and said tray top are substantially parallel to a horizontal use position wherein said mount bracket and said tray top are substantially perpendicular; and a brace hingedly secured to a bottom surface of said tray top such that said brace is pivotally positionable from a first position wherein said brace is substantially parallel to said tray top when said tray top is in said vertical stored position to a second position wherein said brace is substantially perpendicular to said tray top and said mount bracket when said tray top is in said horizontal use position.

21. The health care chair of claim 20 wherein said attendant tray further comprises said tray top defines a table top having a cutout portion along a central portion of an outer lateral edge thereof.

22. The health care chair of claim 20 wherein said attendant tray further comprises a bottom surface of said tray top has a recess formed therein for receiving said brace when said tray top is in said substantially vertical stowed position.

23. The health care chair of claim 20 wherein said attendant tray further comprises a pair of protuberances disposed on said mount bracket laterally adjacent said brace in said vertical position for centering said brace.

* * * * *